United States Patent [19]

Wiebe

[11] 3,995,720

[45] Dec. 7, 1976

[54] TRUCK DAMPING

[75] Inventor: Donald Wiebe, Sewickley, Pa.

[73] Assignee: A. Stuck Co., Pittsburgh, Pa.

[22] Filed: July 15, 1974

[21] Appl. No.: 488,263

Related U.S. Application Data

[60] Division of Ser. No. 134,126, April 15, 1971, Pat. No. 3,837,292, which is a continuation-in-part of Ser. No. 857,274, Aug. 22, 1969, Pat. No. 3,595,350, which is a continuation-in-part of Ser. No. 709,142, Feb. 28, 1968, abandoned.

[52] U.S. Cl. ..... 188/33; 105/1 A; 105/197 DH; 188/320; 267/9 A; 267/9 C

[51] Int. Cl.[2] ..... B61F 5/06; B61F 5/12; B61F 5/24; B61H 11/00

[58] Field of Search ..... 188/33, 195, 320; 105/197 DH, 1 A; 267/9 A, 9 C

[56] References Cited

UNITED STATES PATENTS

| | | | |
|---|---|---|---|
| 2,256,868 | 9/1941 | Perkins | 105/197 DH |
| 2,573,165 | 10/1951 | Settles | 105/197 DH |
| 2,587,315 | 2/1952 | Haynes | 105/197 DH |
| 3,438,339 | 4/1969 | Moehling | 105/197 DH |
| 3,464,366 | 9/1969 | Seay | 105/197 DH |
| 3,595,350 | 7/1971 | Wiebe | 105/197 DH |
| 3,773,147 | 11/1973 | Wiebe | 188/33 |
| 3,837,292 | 9/1974 | Wiebe | 105/197 DH |

*Primary Examiner*—Robert J. Spar
*Assistant Examiner*—Howard Beltran
*Attorney, Agent, or Firm*—Howard E. Sandler

[57] ABSTRACT

A method of damping relative movement between components of a railway car and more particularly a method of damping such movement which is operable only when the railway car is normally operating in a loaded condition.

10 Claims, 9 Drawing Figures

TRUCK DAMPING

This application division of application Ser. No. 134,126, filed Apr. 15, 1971 (now U.S. Pat. No. 3,837,292) which in turn is a continuation-in-part of Application Ser. No. 857,274, filed Aug. 22, 1969, now U.S. Pat. No. 3,595,350, which in turn is a continuation-in-part of application Ser. No. 709,142 filed Feb. 28, 1968, now abandoned.

The structure of this invention provides an external reservoir for hydraulic fluid which cooperates with the snubber cylinder space to virtually eliminate the dead space or ullage volume normally necessary, at the top, within a closed hydraulic cylinder to provide for the volume of hydraulic liquid displaced by the piston rod when the piston is forced to the bottom of the cylinder. In the structure of this invention the external reservoir provides the ullage volume necessary for the operation of the piston within the cylinder so that the cylinder can be designed to operate effectively over its full stroke, with practically zero ullage volume within the cylinder.

It is therefore an object of this invention to provide a new and improved side frame snubber designed to operate at full efficiency as an energy absorbing structure throughout the full stoke of the piston within the cylinder to damper the movement of the bolster.

These and other objects and advantages of the snubber of this invention will become more readily apparent upon consideration of the following description and drawings in which.

Figure 3:
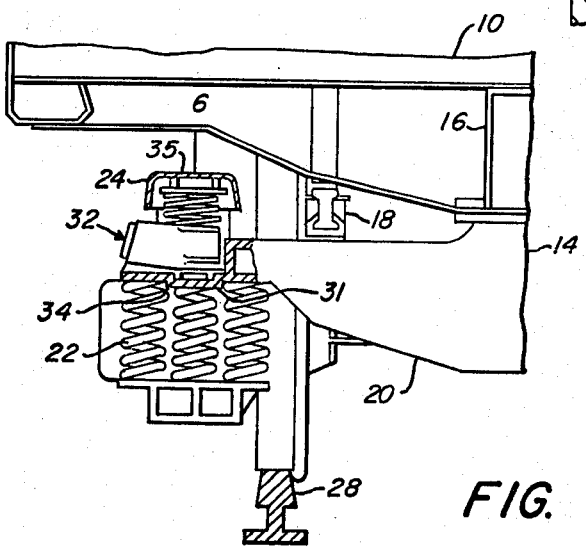
FIG. 3 is a fragmentary partially sectional and elevational view of a freight car body and truck incorporating the snubber of this invention.
Figure 4:
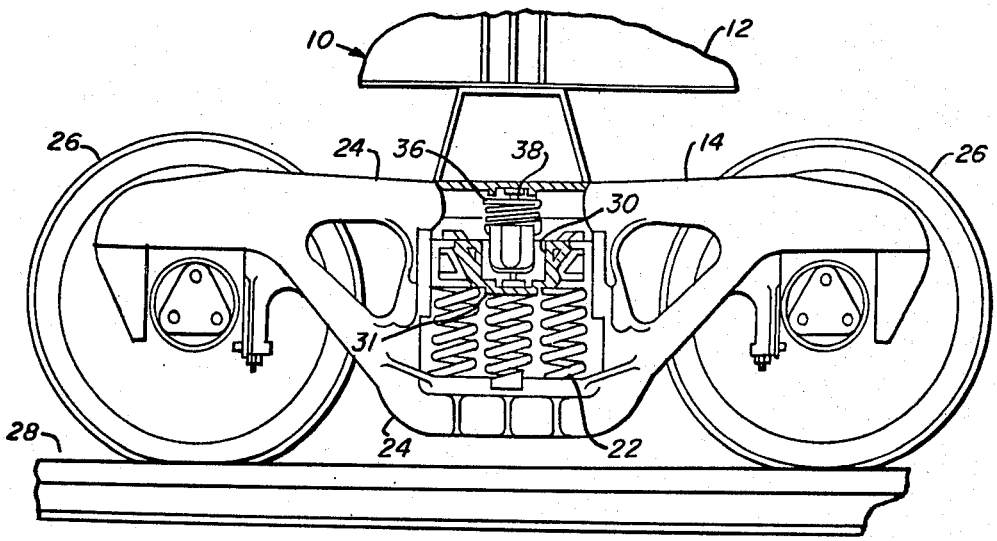
FIG. 4 is a side elevational, partially sectional view of the structures shown in FIG. 3.
Figure 6:
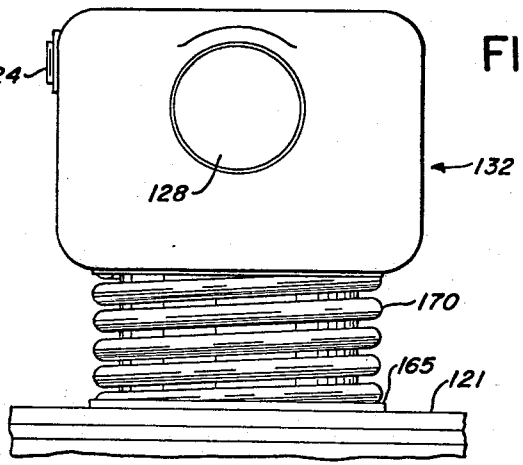
FIG. 6 is an and elevational view of the snubber of FIG. 5.
Figure 7:
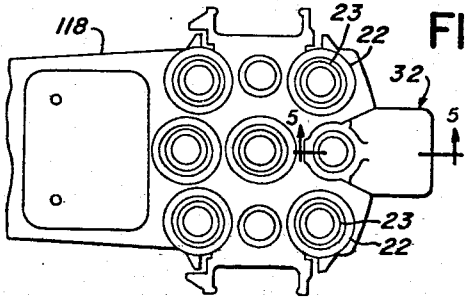
FIG. 7 is a top plan schematic view of a spring group incorporating the snubber of FIG. 5.

Referring now to the drawings, FIG. 4 shows a fragmentary portion of a railway car 10 comprising a freight car body 12 supported by a four-wheel truck (only one half being shown) by way of a center plate 16 and side bearings 18 (see FIG. 3) cooperating with a bolster 20, mounted upon two sets of compression type springs 22, mounted in a pair of side frames 24 each supported by a pair of suitably journaled wheels 26 resting upon a pair of tracks 28 all as well known to those familiar with the field of railway car design.

The bolster 20 is of conventional design except that an opening 30 has been formed in each end portion of the bolster 20 to provide space for mounting a snubber 32 constructed according to the principles of this invention. The bottom surface of the open space 30 has a downwardly recessed portion 31 positioned centrally of the opening 30 to accept and maintain the positioning of a substantially square cup shaped lower mounting element 34 hereinafter more fully described (see FIG. 1).

Side frame 24 is likewise of conventional construction except that at a central portion of the underside of its top member there is formed a downwardly depending ring element 36 having a blind central opening of substantially square outline therein to accept, and maintain the positioning of a generally inverted cup shaped upper mounting element 35 (hereinafter more fully described, see FIG. 1) with the snubber 32 extending between the lower mounting element 34 and the upper mounting element 35 cooperating to form a pair of bearing surfaces for the reaction imposed upon the snubber 32 by the bolster 20 and the side frame 24 as hereinafter more fully set forth.

As shown in FIGS. 3 and 4 the mounting elements 34 and 35, respectively, are of generally rectangular or square outline with a concave internal depression 40 of partial cylindrical form in each mounting element 34, 35. The cylinder axis of each depression 40 is contained in a plane normal to the outer surface of the respective mounting element 34, 35 and also normal to opposite sides of the square outline of the respective mounting element.

Seated in and cooperating with the depression 40 of the bottom mounting element 34 is a snubber bottom member 42 of generally rectangular or square outline having a convex partially cylindrical bottom surface 44 and having its cylinder axis in the same plane as that described for the concave surface of the depression 40.

The snubber 32 comprises a generally hollow cylindrical body member 48 having a central opening 49 in the bottom thereof, closely receiving and retaining in fluid tight relationship an upwardly extending cylindrical portion of the snubber bottom member 42 to form a closed bottom for the internal cylindrical surface 50 of the body member 48 wherein a suitable piston 52 is axially reciprocable. The piston 52 is rigidly secured to and movable by an upwardly extending cylindrical piston rod member 54 which extends upwardly throughout the axial length of the body member 48, through and beyond an annular cylinder closure member 56 mated to and closely received by the cylindrical surface 50 and maintained in fluid tight relationship with the cylinder 50 and the exterior of the piston rod 54 by suitable sealing members such as O rings 58 and U-type seals 60, respectively, or other suitable sealing elements. A lock ring 62, or other suitable retaining means, secures the cylinder closure member 56 within the cylindrical surface 50 while the piston rod 54 is maintained in slidable relationship with the central bore in the cylinder closure member 56 as is well known in the hydraulic cylinder art. Mounted on the upper end of the piston rod 54 and rigidly secured thereto as by one or more threaded retaining elements such as a cap screw 64 is an inverted cup-shaped snubber top member 66 having a convex partial cylindrical reaction surface 44 thereon of the same character and radius as the reaction surface 44 of the snubber bottom member 42 herein before described.

Abuttingly engaged with a lower surface of the exterior of the snubber top member 66 is a spring retaining cap member 68 rigidly secured by the snubber top member 66 to travel with the piston rod 54 in axial reciprocation. A cylindrical compression type spring 70 is engaged between the underside of the cap member 68 and an external shoulder 72 formed on the outer surface of the cylindrical body member 48 and is sufficiently compressed so that in the absence of other forces the spring 70 will extend the piston rod 54 from the body member 48 until the piston 52 contacts the bottom of the cylinder closure member 56 in a manner common to single acting hydraulic cylinders.

The piston 52 and the piston rod 54 are similar to that described and shown in the above-cited copending application in that the piston 52 is provided with a central bore 74 which communicates with a blind central bore 76 in the piston rod 54 when the pressure on the bottom of the piston 52 is great enough to raise a ball valve 78 biased against the upper end of the central bore 74 by a spring 80 captively mounted in a compressed condition within the blind bore 76. The piston 52 is also provided with a plurality of bores 82 extending therethrough from its bottom to its top surface and communicating with the central bore 74 by respective horizontal passages 84. In the position shown in FIG. 1 the bores 82 are closed by a flat ring valve 86 covering the bottom ends of the bores 82 whenever pressure below the piston is substantially greater than pressure above the piston due to downward motion of the piston 52 within the cylinder 50. The valve 86 is free to move downwardly with respect to the bottom of the piston 52 a limited distance and prevented from moving farther in the axial direction with respect to the piston 52 by a suitable snap ring 88 mounted on a downwardly extending cylindrical portion of the piston 52 as described in the above cited copending application.

Figure 1:
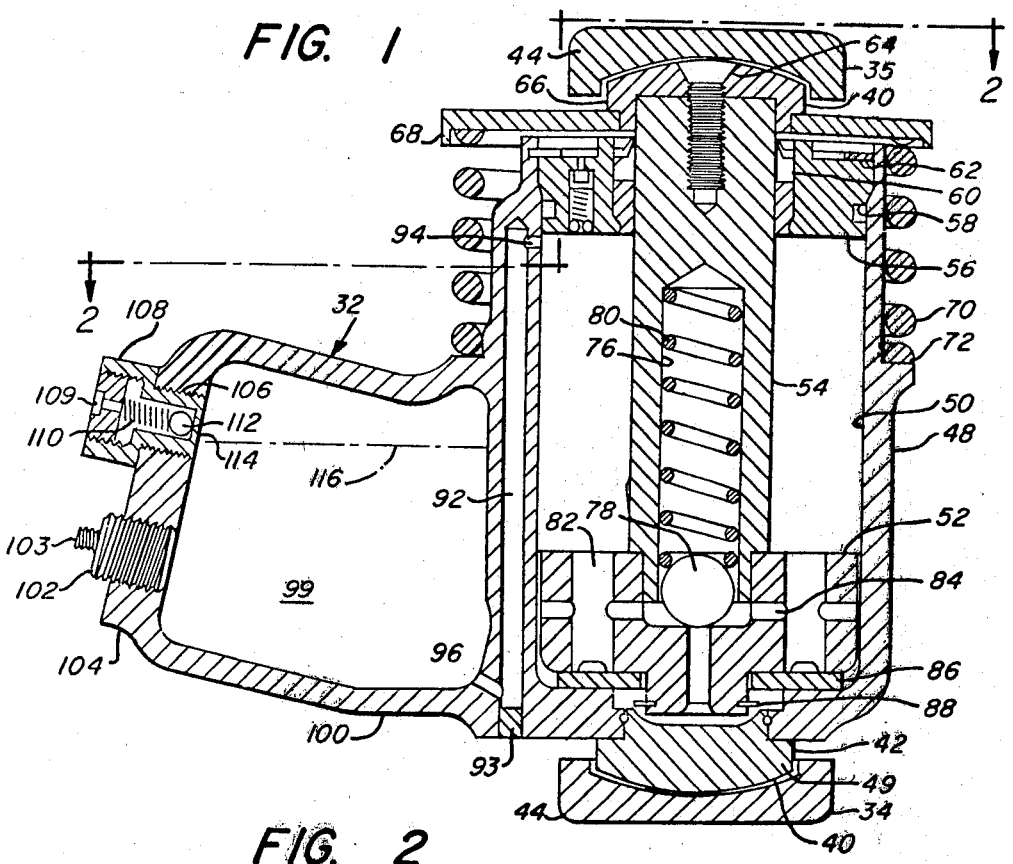
FIG. 1 is a median sectional view of a snubber constructed according to the principles of this invention.

The body member 48 has a thick wall portion 90 (see FIG. 2) extending from the bottom of the body member 48 up to an area slightly above the bottom surface of the cylinder closure member 56 (as best seen in FIG. 1). Within the wall portion 90 is formed a pair of passageways such as elongated bores 92 having axes parallel to the axis of the cylinder 50 and extending within the wall portion 90 from the bottom of the body member 48 nearly to the top of the thick portion 90 at least as far up as the bottom surface of the cylinder closure member 56. At a point just below the bottom surface of the cylinder closure member 56 horizontal passageways 94 communicate between the interior of the cylinder 50 and the passageways 92, respectively. Similar substantially horizontal passageways 96 communicate between lower end portions of the bores 92 and the interior space 99 of a generally rectangular, substantially horizontally extending reservoir or hollow tank element 100 formed as a lateral extension of the body member 48 secured to or formed integral with the lower half of the body member 48. The bottom ends of the bores 92 are sealed by plugs 93 so that the interior space 99 communicates with the cylinder 50 through the passageways 96, 92 and 94 with the result that hydraulic liquid within the cylinder 50 can be displaced outwardly into the interior space 99 of the tank element 100 or caused to flow in the opposite direction as hereinafter more fully described.

The tank element 100 is provided with a threaded hollow plug 102 suitably threadedly engaged in a filler opening in the lower portion of an outer end member 104 of the tank element 100 and having a suitable check valved connection 103 thereon to provide for filling the interior of the tank element 100 with liquid by the application of a suitable pressurized fluid conducting element (not shown) to the valve fitting 103 in a well known manner. A second threaded bore 106 communicates with an upper portion of the interior of the tank element 100 and has threadedly engaged therein an adjustable valve 108 provided with an internally threaded stepped bore 114 in which is engaged an adjusting element 109 captively securing a spring 110 biasing a ball valve 112 into engagement with a smaller portion of the bore 114 which communicates between the upper portion of the inner chamber of the tank element 100 and the ambient atmosphere. The adjusting element 109 is suitably adjusted so that the ball valve 112 will remain seated and prevent communication between the interior of the tank element 100 and the ambient atmosphere until the pressure within the interior space 99 of tank element 100 exceeds that of the ambient atmosphere by at least a pre-selected amount, preferably approximately 2–5 atmospheres in the present embodiment.

OPERATION

With the above described snubber 32 fully assembled and in the upright position as shown in FIG. 1 but with the piston rod 54 fully extended and the piston 52 abutting the bottom surface of the cylinder head 56 a suitable liquid having the requisite physical and chemical characteristics for use as a pressure transfer medium within an hydraulic cylinder is pumped into the space 99 through the connection 103 until compression of the air within the space 99, the bores 92 and the cylinder 50 produces a pressure of approximately five atmospheres. Under such pressure the air within the communicating spaces 99, 92 and 50 will be compressed to approximately one fifth its original volume with approximately four fifths of the tank space 99 and the cylinder 50 being filled with liquid so that the liquid in the tank reaches a level approximately that indicated by a horizontal line 116 across the space 99 (see FIG. 1). The stepped bore 114 is suitably located so that its inner end portion communicating with the space 99 determines the level 116 so that liquid flows out of the bore 114 when the tank is being filled and whenever the pressure within the space 99 overcomes the spring 110 at the pressure for which the valve 108 has been set. The level 116 must be far enough above the level of bores 96 so that the bores 96 are always submerged under operating conditions.

When the piston rod 54 is pushed downwardly into the cylinder 50 the piston 52 travels downwardly with the valve 86 open as long as the downward motion of the piston 52 is slow enough to avoid substantial pressure differential between the upper and lower sides of the piston 52 so that the liquid below the piston can flow upwardly through the bores 82 into the space within the cylinder 50 above the piston 52. During the inward motion of the piston rod 54 liquid and air must be displaced from the cylinder 50 because of the volume occupied by the increased portion of the piston rod 54 within the cylinder 50 (displacement volume). With a newly filled snubber 32 approximately one fifth of the space within the cylinder 50 will be occupied by air which, because of gravitational effect, will be accumulated at the top of the cylinder 50 so that displacement of the piston rod volume will increase the air pressure within the cylinder and force air in the top of the cylinder 50 to travel outwardly through the passageways 94, downwardly through the bores 92, horizontally outwardly through the passages 96 into the space 99 where the air will rise in the form of bubbles through the liquid in the space 99 to become part of the trapped air volume above the level 116 within the space 99.

When the piston rod 54 again moves upwardly within the cylinder 50, removal of a portion of the volume of the rod 54 from the interior of cylinder 50 provides space for more oil within the cylinder 50 and this amount of liquid will be supplied by liquid from the space 99 flowing through the passages 96, upwardly through the bores 92, and horizontally inwardly through the passages 94, into the cylinder 50. Successive up and down motions of the piston rod 54 will thus cause an exchange of air in the cylinder 50 and oil in the space 99 until the cylinder 50 is completely filled with oil.

It is to be noted that the combined cross sectional area of the bores 92 or equivalent passageway means must be large enough to allow free flow of liquid therethrough (no orifice effect). Furthermore the total volume of such passageway or bores 92 must be small enough so that normal rod movement into cylinder 50 to within an inch of fully closed will displace more than enough liquid to completely fill the bores 92. Or vice versa this amount of liquid must flow into the cylinder during rod extension to originally displace the air and thereafter to keep the cylinder full of liquid at all times.

It is to be appreciated that without the tank element 100 and the communicating passageways as hereinabove described it has always been necessary in prior art snubbers to provide at least some liquid free space or ullage volume at the top of the cylinder so that displacement of liquid by the piston rod entering the cylinder would not cause unwanted overpressuring of the cylinder 50 with resultant damage to the sealing elements and unacceptable loss of the hydraulic fluid.

Because of the transfer of ullage volume in the present invention from the top of the cylinder 50 to the top of the space 99 the snubber 32 of this invention is usable throughout the total length of piston stroke since the piston is always completely covered by and filled with the hydraulic liquid and no space need be left empty at the top of the cylinder as was necessary in prior art snubbers.

The minimum volume unfilled by liquid within the space 99 above the level 116 (hereinafter the ullage volume) should not be less than approximately 150% of the volume of that portion of the piston rod which moves into and out of the cylinder 50 below the cylinder head 56 (hereinafter the displacement volume), to avoid overpressuring the snubber at full stroke, and to avoid preventing the flow of the air which has been pressurized in the top of the cylinder 50 through the passageways 94 and 96 and the bores 92. This ullage volume in the reservoir is preferably three to four times the volume of the bores 92 and the communicating passageways 94 and 96 with the passageways of a diameter to allow free flow of liquid with very little pressure drop. This ratio of volumes has been found to be great enough to give free volume above the level 116 sufficient to permit displacement of the column of liquid in the bores 92 to provide for purging of air from the bores 92 into the space 99. Thus the volume of the bores 92 must always be less than one half the total piston rod displacement volume so that flow of air from the bores 92 into the space 99 will not be prevented by compressibility of the air.

Operation of the snubber 32 of this invention is similar to that described for the snubber of my copending U.S. application Ser. No. 801,884, now Pat. No. 3,626,864, except for the flow of liquid into and out of the cylinder 50 and the space 99 as hereinabove described. Such operation of course includes the "dead band operation" and the free flow of oil through the piston 52 during slow downward movement of the piston 52 within the cylinder 50 as well as the high pressure energy absorbing flow of oil through the passageway 74 in the piston 52 past the ball valve 78 after compression of spring 80, during rapid downward movement of the piston 52 which closes the valve 86, all as described with relation to the side frame snubber of the above cited application.

Figure 2:
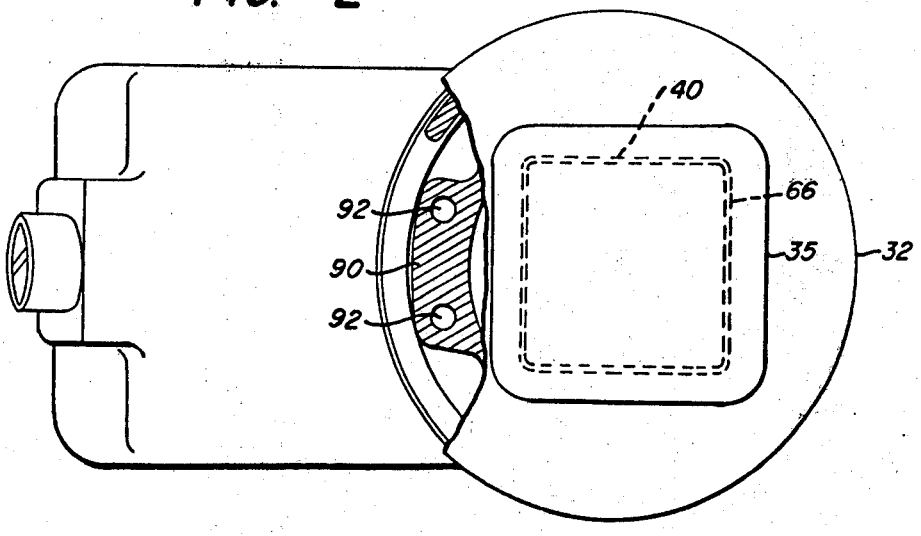
FIG. 2 is a partially sectional view of the snubber of FIG. 1 taken substantially on line 2—2 of FIG. 1.

Referring again to the drawings, FIGS. 5 through 8 show another embodiment of a reservoir type snubber 132 constructed according to the principles of this invention and quite similar to the reservoir type snubber 32 of FIGS. 1 and 2 excepting the snubber 132 of this embodiment is a spring group snubber, i.e. the snubber 132 is designed to replace one of the springs 22 of the standard spring group interposed between a standard bolster 118 and a standard side frame 120 in the truck of a railway freight car such as that indicated at 10 in FIG. 3.

The application of the snubber 132 is very similar to that described and illustrated in my copending application Ser. No. 801,884 filed Oct. 23, 1968, which also illustrates a spring group snubber. It is of course obvious that the spring group snubber type has the advantage of being applicable to a standard side frame and standard bolster with a minimum of reconstruction thus saving the expenses of designing and building special bolsters and side frames with the attendant expenses of special parts to be stocked and accounted for.

Figure 5:
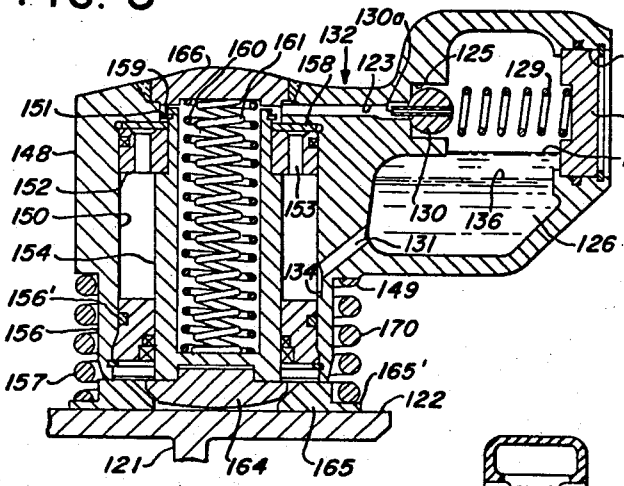
FIG. 5 is a sectional view of another snubber constructed according to the principles of this invention; taken substantially on line 5—5 of FIG. 6.

As best seen in FIG. 5 the snubber 132 comprises a body member 148 which provides a hollow cylindrical surface 150 in which a piston 152 is reciprocated by action of a piston rod member 154 which extends downwardly from the piston 152 through a closure member 156 rigidly secured in the lower open end of the cylinder 150 as by snap ring 157 and maintained in fluid tight relationship with the cylinder 150 by resilient members such as O-rings 156' or the like.

Figure 8:
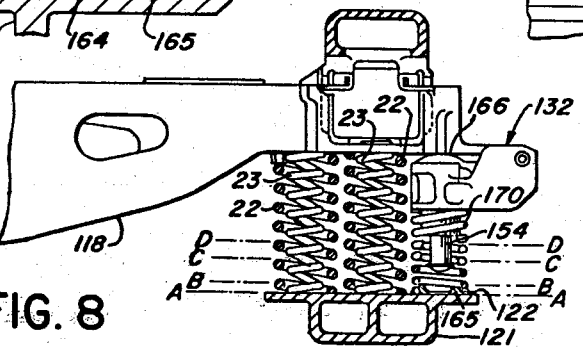
FIG. 8 is a fragmentary partially sectional schematic view of the spring group of FIG. 7.

The top end of the cylinder 150 is permanently closed by a top member 166 secured in a stepped portion of the cylinder 150 as by welding. The top member 166 is shown as having an upwardly convex surface contacting the underside of the bolster end in place of the conventional spring as best seen in FIG. 8. It is to be seen that the snubber 132 replaces any one of the three outside springs 22 of the truck spring group along with one of the inner spring 23 shown in FIG. 8 to be coaxial with and cooperating with the outer springs 22 in a manner well known in railroad circles.

The bottom end of the piston rod 154 is provided with a solid bottom member 164 having a downwardly convex surface and a bottom edge chamfer adapted to be received in a mounting ring 165 secured or trapped in place between a spring 170 and the uppersurface 122 of the side frame bottom member 121. The body support spring 170 surrounds a reduced diameter outside surface portion of the body member 148 and is interposed between an annular shoulder 149 of the body member 148 and the shouldered top surface 165' of the mounting ring 165. As best seen in FIG. 8 the body spring 170 in this position supports the body member 148 in all relative positions of the bolster and side frame and holds the mounting ring 165 in place.

The internal workings of the snubber 132 are quite similar to those of the snubber 32 of the first embodiment with the difference that the snubber 132 is in many respects a top to bottom reversal of the snubber 32. The piston 152 is provided with a ring of vertical through bores 153 having axes parallel to the axis of the piston rod 154 and circumferentially spaced about the axis of the piston 152 and radially equidistant therefrom. Covering the top ends of the bores 153 is an annular disc valve 158 loosely slidable upon a through piston extension portion of the piston rod 154 and prevented from displacement off this extended portion by means such as the snap ring 159 which nevertheless allows the valve 158 to move far enough away from the bores 153 to allow a free flow of hydraulic fluid therethrough. The piston rod 154 is of course sealingly slidable through the closure member 156 and the piston and piston rod 154 are biased downwardly by coaxial double compression springs 160 and 161 outer and inner, respectively. The piston 152 is movable upwardly in the cylinder 150 until it comes in contact with the shoulder formed by the transition from the full diameter portion of the cylinder 150 to a smaller diameter portion 151 and this smaller diameter portion 151 extends upwardly to the bottom side of the top member 166 forming a small diameter top cylinder portion at the extreme upper end of the cylinder 150. This small diameter portion 151 communicates with a passageway 123 extending substantially horizontally to the right as seen in FIG. 5 to an enlarged passageway portion 125 which in turn communicates with the cavity of a reservoir 126 formed in a horizontally extending portion of the body member 148. The bore 123 must be large enough to provide for free flow of hydraulic liquid (no orifice effect) probably not less than one eighth inch in diameter. The reservoir 126 is provided with a large horizontal bore 127 coaxial with the passageways 123 and 125 through the outer wall of the reservoir 126. Rigidly secured within the bore 127 is a closure member 128 provided with a snap ring and O-ring to maintain the fluid tight relationship of the closure member 128 with the bore 127. The closure member 128 forms a seat for a valve spring 129 interposed between the inner surface of the closure member 128 and a spherical valve 130 which is positioned in the portion 125 to close off the reservoir end of the passageway 123 in a well known manner. An orifice 130*a* is shown as a bore through valve 130 coaxial with the bore 123 and of a size to provide for viscous flow of hydraulic liquid under pressures ranging from a few atmospheres to whatever pressure will unseat the valve 130 probably around 140 atmospheres.

At this point it is well to note that the total volume of bore 123 plus the clearance volume within cylinder portion 151 with the piston at maximum height must be less than 1% of the piston displacement volume to provide for progressive clearing of air from the cylinder 150 to be replaced with liquid.

The reservoir 126 also communicates with the cylinder 150 through a passageway 131 extending from a lower portion of the reservoir 126 to a lower portion of the cylinder 150 wherein the passageway 131 is provided with a downwardly extending cylinder relief portion 134 extending downwardly from the passageway 131 in the wall of the cylinder 150 to a point upwardly adjacent the upper side of the closure member 156 for a purpose to be made clear.

When the snubber 132 is assembled with the body spring 170 it extends between the side frame bottom member 121 and the bolster bottom surface 168 as seen in FIG. 8. Also as seen in FIG. 8 the top surface 122 of the side frame bottom member 121 will, when the bolster and side frame are assembled but not supporting a car, be at a level indicated by the line A—A relative to the bolster 118. When a car body is placed on the truck of which this side frame 120 and bolster 118 are a part, the relative position of the top surface 122 of the side frame bottom member 121 will be at a position, relative to bolster 118, represented by the horizontal line B—B. This would be the unloaded car position and it is well illustrated that in this position there would be little or no action by the snubber 132 even if the car should bounce somewhat or rock slightly as it was being propelled over the rails. The next horizontal line upward from line B—B namely line C—C represents the normal position of the top surface 122, relative to bolster 118, with a loaded car and it is to be seen that at this time the hitherto fully downwardly extended piston rod 154 will be forced upwardly into the cylinder 150 by the slight amount represented by the height of the line C—C above the downwardmost positioning of the bottom member 164 in FIG. 5. The topmost of the horizontal lines namely D—D represents the position of the top surface 122 relative to the bolster 118 when the spring group has been completely collapsed into solid condition. At this positioning the piston 152 will be very nearly in contact with the shoulder at the top of the cylinder 150 while the mounting ring 165 is almost in contact with the bottom edge of the body member 148 with the parts almost in the position shown in FIG. 6.

By using a plug 124 in the forward wall of reservoir 126 (see FIG. 6) the inside of the body member 148 of the snubber 132 is properly filled with hydraulic liquid such as oil or other suitable liquid so that when in operation the level of liquid in the reservoir 126 will vary between a low level 136 shown as a broken line in FIG. 5 when the piston is at the bottom of the cylinder 150 and the rod 154 completely extended to the position shown in FIG. 8, and rising to the level shown as line 138 in FIG. 5 when the piston 152 has been pushed to the top of the stroke approximateley as seen in FIG. 5.

OPERATION

In beginning the operation of a new snubber 132 there will likely be air trapped in the cylinder 150 and if the piston rod 154 is completely extended as seen in FIG. 8 all of the air in the cylinder 150 will be above the piston 152 by simple gravitational accumulation. At this time the level of liquid in the reservoir 126 will be at some unknown point higher than the level 136 because of the presence of air in the cylinder 150. As the piston 152 rises cyclically in the cylinder 150 because of the motion of the car, air above the piston 152 will be pushed through the small cylinder portion 151, ahead of oil present above the piston, into the passageway 123 and through orifice 130a or around the valve 130 into the upper regions of the reservoir 126. Thus, with the rod 154 being cyclically pushed into the cylinder 150 the level of the liquid in the reservoir 126 will gradually fall during the first few strokes as more and more air is gravitationally accumulated at the top of the cylinder 150 in the portion 151 and forced outward through the passageway 123. After a reasonable number of piston excursions upwardly and downwardly in the cylinder 150 the cylinder 150 and the bores 153 will be essentially completely filled with liquid with very little if any air remaining at the top of the small bore portion little if any air remaining at the top of the small bore portion 151 or in the passageway 123.

The snubber 132 is now ready for normal operation very similar to that described for the spring group snubber of the above copending application or for the embodiment of FIGS. 1 through 4 of this application. As hereinbefore mentioned, the limit of extension of the piston rod 154 precludes any action of the snubber 132 with a light car so that true operation of this device begins with a loaded car being moved along a railway and responding to the variations in track height in a well known manner. With the car standing level or traveling on a level track the normal position of the piston 152 will be slightly raised from the upper surface of the closure 156 with the liquid in reservoir 126 at a level slightly above the line 136 since a small amount of the piston rod 154 has been forced into the cylinder 150 displacing a small amount of liquid. As the car begins to rock a first motion could be the downward motion of the bolster 118 toward the side frame bottom member 121 forcing the piston 152 higher into the cylinder 150. This action would force liquid from the upper side of the piston through the small cylinder portion 151 and the passageway 123 through the orifice 130a or out under the spherical valve 130 against the force of the spring 129 concentrated on a very small area at the end of the bore 123. When flow of liquid from cylinder 150 is taking place only through the orifice **130*a* energy absorption will be of the viscous flow type. This type of flow will be significant only during relatively slow bolster movement with respect to the side frame. However, during more rapid and forceful bolster movement forced displacement of the liquid above the piston 152 through the narrow opening formed by the slightly displaced valve 130 provides constant pressure energy absorption in a manner well known to be valuable in preventing excessive spring action whether in railroad cars or other vehicles. As the piston 152 is forced into the cylinder 150 the piston rod 154 of course displaces more and more liquid from the cylinder 150 into the reservoir 126 raising the level of the liquid to the line 138. The volume represented by the difference in the height 136 and 138 is the ullage volume that would be the minimum necessary to leave free in the cylinder for displacement purposes if the cylinder were not connected to an outside reservoir such as the reservoir 126.**

When the bolster 118 begins to rise with relation to the side frame 120 the piston travels downwardly in the cylinder 150 and is able to do so readily and rapidly because the annular valve 158 will lift off the surface of the piston 152 as soon as the pressure below the piston is even slightly greater than the pressure above the piston as it travels downwardly. Since the valve 130 acts as a check valve liquid will not come into the top of the cylinder 150 from the passageway 123, nor will air except a small amount by leakage or through the orifice **130*a*. But the liquid below the piston 152 will travel upwardly through the bores 153 to keep the top of the cylinder full of oil even though the piston is traveling downwardly and the piston rod 154 is being removed from the cylinder and displacing less and less liquid therefrom so that liquid must now travel downwardly through the passageway 131 into the cylinder 150 to maintain a full cylinder at all times. If a small amount of air should travel inwardly through the passageway 123 into the cylinder 151 it will remain at the top of the cylinder by gravitational accumulation and will be the first fluid expelled when the piston 152 is again forced inwardly of the cylinder 150.**

With the snubber 132 there will be a small amount of non-absorbing or "dead band effect" for small rapid vibrations when the piston 152 moves rapidly downward forcing valve 158 off the top surface of piston 152 which then quickly moves upwardly a short distance before valve 158 has regained its seated position so that no piston displacement of liquid has occurred. For greater dead band effect a spring (not shown) can be interposed between valve 158 and piston 152 to prolong the above described action during less rapid or larger piston excursions.

It is further to be noted that the minimum volume of air space above the level 136 must be greater than one-fifth of the rod displacement volume to avoid overpressuring reservoir 126 and the minimum normal operating level would have a volume of oil between the top end of passageway 131 and level 138 at least equal to the total possible piston rod displacement to avoid adding air to cylinder 150 during the piston downstroke.

A further variation within the principles of this invention includes using a valve (not shown) similar to valve 130 but no orifice therein. Operation of such a snubber with no orifice would be limited to the constant pressure mode described above with a similar small dead band effect variable by use of a spring between piston 152 and valve 158 as earlier mentioned.

Figure 9:
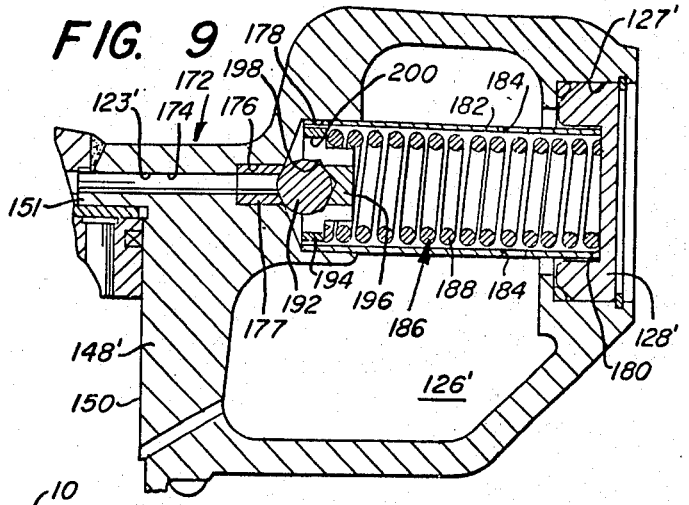
FIG. 9 is a partial sectional view of still another snubber constructed according to the principles of this invention and similar to the embodiment shown in FIG. 5.

FIG. 9 is a partial cross-sectional view of still another embodiment of a snubber 172 constructed according to the principles of this invention. Snubber 172 is quite similar to the snubber 132 described hereinabove with the primary difference therebetween being in the passageway communication between the upper end of cylinder 150 and the reservoir 126' and the valving arrangement therebetween. Accordingly, like elements will be designated by the same reference numerals and similar elements will be designated by the same reference numerals primed. Inasmuch as snubber 172 is identical to snubber 132 as set forth hereinbefore with the exception of the differences described hereinabove, FIG. 9 illustrates only such differences with the understanding that reference is to be made to FIGS. 5–8 for identical and similar features and positioning.

In snubber 172, portion 151 of cylinder 150 communicates with a passageway 123' which extends substantially horizontally outwardly (to the right as seen in FIG. 13). Passageway 123' communicates between portion 151 and the cavity of the reservoir 126' formed in a horizontally extending portion of the body member 148' and comprises: an inner portion 174; an intermediate portion 176 which has a diameter thereof larger than the diameter of portion 173 and receives an annular seating sleeve 177 therewithin and an enlarged diameter outer portion 178. The inner diameter of sleeve 177 is shown as being equal to the diameter of passageway portion 174.

The reservoir 126' is provided with a large horizontal bore 127' which extends through the outer wall of the reservoir 126' and is coaxial with bore 123'. A closure member 128' is sealingly secured within bore 127'. Closure member 128' has a circular seating portion 180 extending outwardly from the innermost end thereof. Portion 180 is of an outer diameter thereof substantially equal to the diameter of passageway portion 178 and is coaxial therewith. A cylinder 182 is positioned intermediate portions 178 and 180 and the respective axial ends thereof are seated within the portions 178 and 180. The outer diameter of cylinder 182 is substantially equal to the outer diameter of portions 178 and 180. A plurality of circumferentially spaced ports 184 extend radially through cylinder 182, are positioned intermediate the axial ends of cylinder 182 and communicate between the interior thereof and the cavity of the reservoir 126'.

A valve assembly 186 is received within cylinder 182. Valve assembly 186 comprises: a valve spring 188; a keeper member 190; and a spherical valve 192. Keeper member 190 has a generally stepped cylindrical configuration and comprises an inner portion 194 and a reduced diameter outer portion 196. Portion 196 has an outer diameter thereof substantially equal to the inner diameter of spring 188 and is received therewithin adjacent one end thereof. Portion 194 has a coaxial seat 198 formed within the inner surface thereof to provide a seating surface for valve 192. A plurality of bores 200 extend horizontally through keeper member 190.

Valve assembly 186 is positioned within cylinder 182 such that spring 188 has one end thereof seated on closure member seating portion 180. The length of spring 188 is such that the outer end thereof which has received keeper member portion 196 therewithin urges valve 192 into engagement with seating sleeve 177 thereby closing off the reservoir and the passageway 123' in a well known manner.

The general operation of snubber 172 is quite similar to the operation of the snubber 132 as described hereinbefore, however, when utilizing the snubber 172 it would be expected that such snubber would operate more efficiently than snubber 132. For example the fluid discharging from the passageway 123 into the cavity of snubber 132 could do so at a relatively high velocity thereby disturbing the air-oil interface and entraining air within the hydraulic fluid. After a period of time an accumulated air entrainment in the system of the snubber 132 could result in an air locked snubber. With an arrangement such as snubber 172 hydraulic fluid would overcome the bias of spring 188, flow through bores 200 into cylinder 182 and be discharged therefrom through ports 184 and into the cavity. The ports 184 are large enough to cut down the velocity of the discharging hydraulic fluid thereby decreasing the occurrences of air entrainment within the hydraulic fluid of the system.

An additional operating feature of the snubber 172 is that because the ports 184 provide a somewhat restricted path for the flow from cylinder 182 a back pressure within cylinder 182 will result thereby decreasing chattering (i.e. movement of valve 192 against adjacent surfaces). Such reduction of chattering decreases maintenance of the snubber for there is less wearing contact between adjacent surfaces. At this point it is to be noted that the diameter or number of ports 184 are determined by the necessity to have enough discharge area to maintain the velocity of discharging hydraulic fluid within an acceptable maximum while simultaneously providing a back pressure which is great enough to decrease chattering but not too great as to hamper the snubbing feature of the snubber 172. Still further the cooperation of sleeve 177 and seat 198 aid in maintaining valve 192 in a steady substantially non-chattering relative position. It is to be noted that it is contemplated that sleeve 177 and keeper member 190 be made of a wear resistent material to withstand the continued frictional wearing thereof.

A further variation of snubber 172 within the principles of this invention includes using a valve 130 such as shown in snubber 132 which has an orifice therewithin. Operation of such a snubber would be essentially as described hereinbefore with reference to snubber 132.

The advantage of the snubber embodiments shown in FIGS. 5 through 9 resides almost completely in the characteristics of being able to be used in place of a normal pair of bolster springs with the attendant advantages as hereinbefore set forth.

Preferred embodiments of this invention having hereinbefore been described it is to be realized that variations in the structure embodying the principles of this invention without departing from the scope of such principles.

What is claimed is:

1. A method of damping relative movement between components of a railway car which is selectively operable in a loaded and unloaded condition and wherein a closed hydraulic damping system having relatively movable portions is located within a spring group normally supporting such components, comprising the steps of: maintaining at least one of said portions out of operative engagement with the adjacent one of said components such that said hydraulic damping system is in standby to damp said relative movement when said railway car is normally operating in said unloaded condition; and damping said relative movement by maintaining operative engagement of both of said portions with respective adjacent ones of said components when said railway car is normally operating in said loaded condition.

2. A method as specified in claim 1 including the additional step of continuously biasing said closed hydraulic damping system towards one of said components.

3. A method as specified in claim 2 including the additional step of partially overcoming said biasing during said last mentioned maintaining.

4. A method as specified in claim 2 wherein said additional step of continuously biasing includes biasing said closed hydraulic system into engagement with said one of said components.

5. A method as specified in claim 2 wherein said components are said bolster member and said side frame member.

6. A method as specified in claim 5 wherein said one of said components is said side frame member and said other of said components is said bolster member.

7. A method as specified in claim 5 wherein said one of said components is said bolster member and said other of said components is said side frame member.

8. A method as specified in claim 2 including the additional step of continuously biasing said one of said portions away from the other of said portions in a direction opposite the direction towards said one of said components.

9. A method as specified in claim 8 wherein said continuously biasing said closed hydraulic damping system towards said one of said components is by biasing means located externally of said closed hydraulic damping system and said continuously biasing said one of said portions away from the other of said portions is by biasing means located internally of said closed hydraulic damping system.

10. A method as specified in claim 2 wherein said relatively movable portions reciprocate along an axis and said continuously biasing is applied to said closed hydraulic system at a location adjacent an axial end of the other of said portions and intermediate the axial ends of said other of said portions.

* * * * *